United States Patent [19]

Beier

[11] Patent Number: 4,592,375

[45] Date of Patent: Jun. 3, 1986

[54] HAIR CURLING ROLLER

[76] Inventor: John K. Beier, 901 S. 89th, Omaha, Nebr. 68114

[21] Appl. No.: 574,408

[22] Filed: Jan. 27, 1984

[51] Int. Cl.[4] ..... A45D 2/02

[52] U.S. Cl. ..... 132/39; 132/40

[58] Field of Search ..... 132/39, 40, 42, 43

[56] References Cited

U.S. PATENT DOCUMENTS

| | | | |
|---|---|---|---|
| 1,908,970 | 5/1933 | Frankel | 132/43 R |
| 2,061,817 | 11/1936 | Van Cleef | 132/43 R |
| 2,925,021 | 2/1960 | Basta | 132/39 |
| 2,994,327 | 8/1961 | Otto et al. | 132/39 |
| 3,294,099 | 12/1966 | Warthen | 132/39 |
| 3,539,436 | 11/1970 | Hamano | 132/0.31 |
| 3,566,885 | 2/1971 | Meyer | 132/39 |
| 3,631,868 | 1/1972 | Solomon | 132/39 |
| 3,837,351 | 9/1974 | Thornton | 132/89 |
| 3,888,266 | 6/1975 | Weldon | 132/39 |

FOREIGN PATENT DOCUMENTS

| | | | |
|---|---|---|---|
| 1145165 | 10/1957 | France | 132/40 |

*Primary Examiner*—Gregory E. McNeill

*Attorney, Agent, or Firm*—Zarley, McKee, Thomte, Voorhees & Sease

[57] ABSTRACT

An elongated cylindrical hair curling roller comprised of polyester fibers adhesively secured together so that the roller will yieldably retain its cylindrical shape and density. Preferably, the fibers are coated with a latex material which binds the fibers together.

4 Claims, 5 Drawing Figures

HAIR CURLING ROLLER

BACKGROUND OF THE INVENTION

Hair rollers are widely used by women to create curls in their hair. Normally, the hair is wrapped or rolled around the rollers and maintained thereon by means of bobby pins, small spears, etc. Many forms of the hair rollers are extremely uncomfortable to wear and more difficult to sleep upon. Further, some of the hair rollers do not permit air to pass therethrough which makes it difficult to dry the hair.

Therefore, it is a principal object of the invention to provide an improved hair curling roller.

Another object of the invention is to provide a hair curling roller which is comprised of polyester fibers bound together.

Yet another object of the invention is to provide an elongated cylindrical hair curling roller which yieldably retains its shape to form the proper curl in the hair but which may be compressed to provide comfort to the wearer.

Yet another object of the invention is to provide an elongated cylindrical hair curling roller which permits air to flow therethrough.

These and other objects will be apparent to those skilled in the art.

SUMMARY OF THE INVENTION

An elongated cylindrical hair curling roller is provided which yieldably retains its shape to provide the proper curl to the wearer's hair and which is compressible to provide comfort to the wearer. The roller is comprised of a plurality of polyester fibers secured together by a binder such as a latex material.

DESCRIPTION OF THE PREFERRED EMBODIMENT

Figure 1:
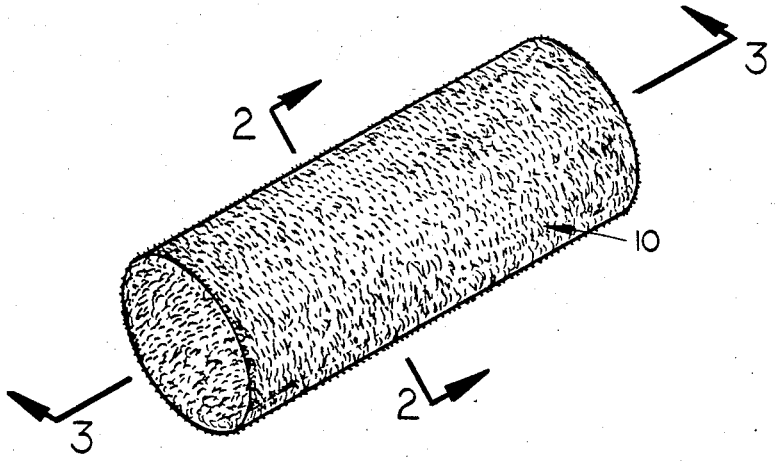
FIG. 1 is a perspective view of the hair curling roller of this invention.
Figure 2:
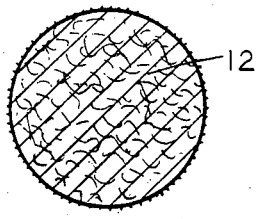
FIG. 2 is a sectional view seen on lines 2—2 of FIG. 1.
Figure 3:
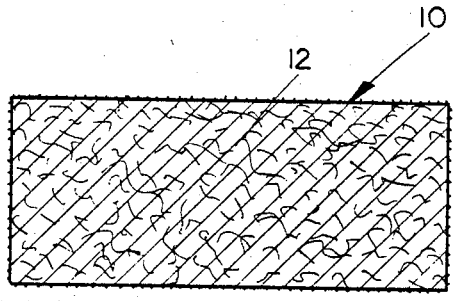
FIG. 3 is a sectional view seen on lines 3—3 of FIG. 1.

The hair curling roller of this invention is referred to generally by the reference numeral 10 and preferably has the elongated cylindrical shape illustrated in FIG. 1. The roller is comprised of a plurality of polyester fibers

12 which are coated with a binder material such as latex or the like referred to generally by the reference numeral 14. The latex or adhesive material bonds the fibers together so that they will yieldably retain the cylindrical shape illustrated in the drawings. One type of binder which will perform satisfactorily is Geon 460×45 manufactured by B. F. Goodrich. Another satisfactory binder is DUR-O-SET 917 manufactured by National Resins. DUR-O-SET 917 is a self-crosslinking, polyvinyl acetate emulsion. Yet another satisfactory binder is RHOPLEX TR-407 manufactured by Rohm and Haas Company which is an acrylic emulsion.

Figure 5:
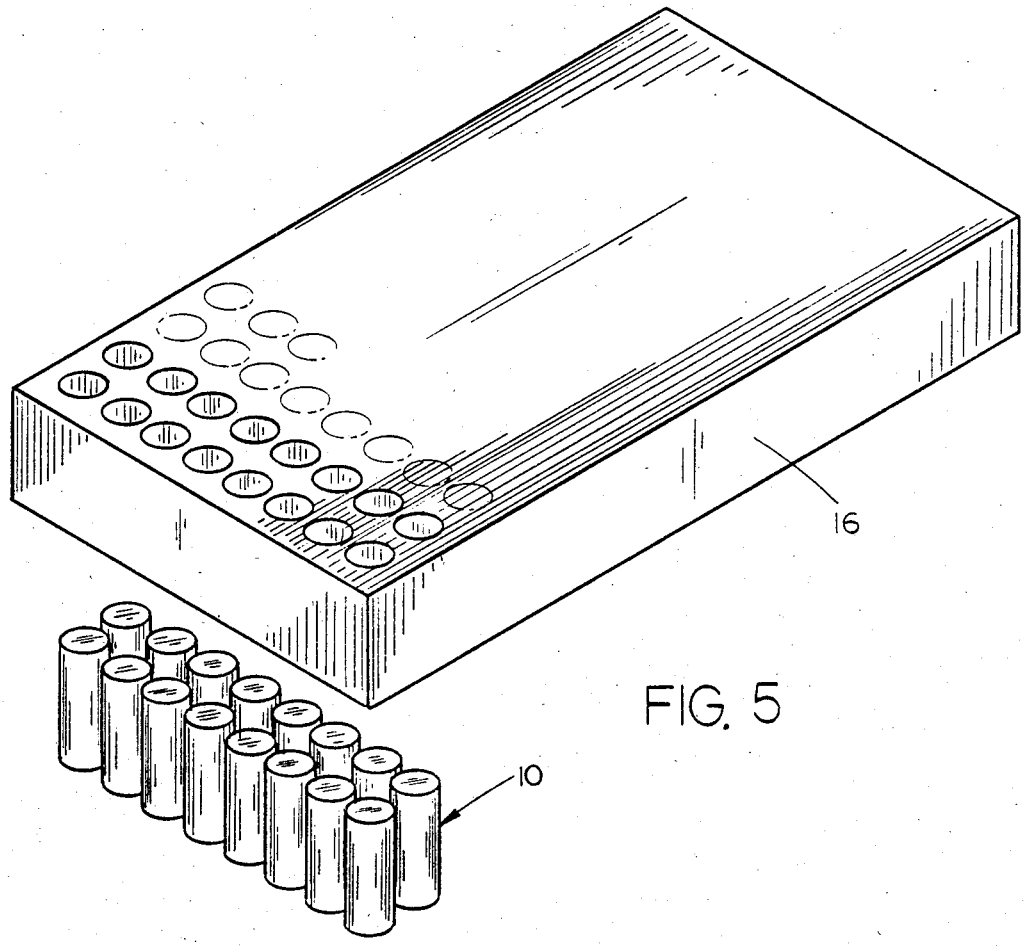
FIG. 5 is a perspective view illustrating one method by which the rollers are formed.

FIG. 5 illustrates one method by which the cylindrical rollers 10 may be formed. A batt 16 of polyester material is provided with the batt 16 having been previously compressed to achieve the proper density of the fiber material. Some form of die cutting machine is provided to cut or punch the rollers 10 from the batt 16. Prior to cutting the rollers 10 from the batt 16, the batt 16 would have been dipped or sprayed with the liquid binder so that the fibers 12 therein are bonded together so that the rollers will yieldably retain their shape and their density.

Figure 4:
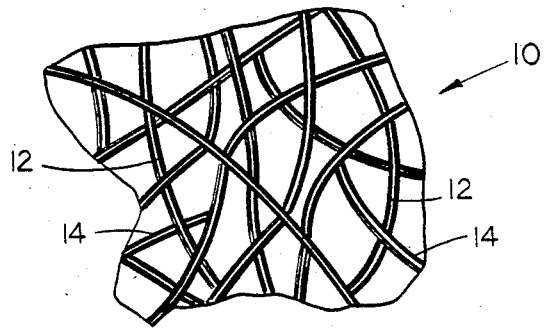
FIG. 4 is an enlarged sectional view illustrating the adhesive material coating the fibers and securing the same together.

In use, the roller 10 is wrapped with hair in the conventional fashion and maintained thereon by means of a short "spear" or the like. The roller 10 is extremely lightweight and will be comfortable to wear since it does not have the bristles of the prior art rollers contained therein. The rollers 10 are compressible so that they will be comfortable to wear during periods that the wearer is sleeping or reclining. The bonding of the fibers by the binder material serves to maintain the fibers in the predetermined configuration and density. The spacing of the fibers as illustrated in FIG. 4 permits air to pass therethrough so that the hair will dry quickly when the rollers are being employed.

Thus it can be seen that the hair roller of this invention accomplishes at least all of its stated objectives.

I claim:

1. An elongated cylindrical hair curling roller comprised of polyester fibers bound together by a binder material so that said fibers and binder material will yieldably tend to retain the cylindrical shape and density of said roller free of any separate stiffening member.

2. The roller of claim 1 wherein said fibers are coated with a latex material which adhesively binds the fibers together.

3. The roller of claim 1 wherein said roller is formed by cutting a cylindrical body from a batt of polyester fibers.

4. The roller of claim 3 wherein the fibers are sprayed with the binder material and allowed to dry before the roller is cut from the batt.

* * * * *